US009498665B2

(12) United States Patent
Warren

(10) Patent No.: US 9,498,665 B2
(45) Date of Patent: Nov. 22, 2016

(54) ENHANCER

(76) Inventor: David Stephen Warren, London (GB)

( * ) Notice: Subject to any disclaimer, the term of this patent is extended or adjusted under 35 U.S.C. 154(b) by 62 days.

(21) Appl. No.: 14/354,857

(22) PCT Filed: Aug. 6, 2012

(86) PCT No.: PCT/GB2012/051895

§ 371 (c)(1),
(2), (4) Date: Apr. 28, 2014

(87) PCT Pub. No.: WO2013/061024

PCT Pub. Date: May 2, 2013

(65) Prior Publication Data

US 2014/0274586 A1 Sep. 18, 2014

(30) Foreign Application Priority Data

Oct. 28, 2011 (GB) ..... 1118660.8

(51) Int. Cl.
*A63B 69/00* (2006.01)
*A63B 23/18* (2006.01)
(Continued)

(52) U.S. Cl.
CPC ..... *A63B 21/00185* (2013.01); *A41D 13/0015* (2013.01); *A63B 21/0004* (2013.01); *A63B 21/4007* (2015.10); *A63B 21/4011* (2015.10); *A63B 21/4013* (2015.10); *A63B 21/4015* (2015.10); *A63B 21/4017* (2015.10); *A63B 21/4025* (2015.10); *A63B 21/4039* (2015.10); *A63B 23/0205* (2013.01); *A63B 23/03508* (2013.01); *A63B 23/03575* (2013.01); *A63B 23/12* (2013.01); *A63B 23/18* (2013.01); *A63B 69/0059* (2013.01); *A63B 21/0023* (2013.01); *A63B 21/0552* (2013.01); *A63B 2209/00* (2013.01); *A63B 2213/00* (2013.01)

(58) Field of Classification Search
CPC ..... A41D 13/0015; A41D 1/007; A63B 21/0023; A63B 21/1449; A63B 2209/02–2209/023; A63B 69/0059; A61F 5/02–5/028; A41C 1/00–1/20; D06H 5/007
See application file for complete search history.

(56) References Cited

U.S. PATENT DOCUMENTS 945,359 A * 1/1910 Adams ..... A61F 5/028 128/DIG. 19
3,255,749 A 6/1966 Smithers
(Continued)

FOREIGN PATENT DOCUMENTS

CN 2164806 Y 5/1994
DE 445382 6/1927
(Continued)

OTHER PUBLICATIONS

"Close-Fit Duct-Tape Dress Form." Threads Magazine. N.p., Oct. 24, 2008. Web. Apr. 27, 2016.*
(Continued)

*Primary Examiner* — Oren Ginsberg
*Assistant Examiner* — Jennifer M Deichl
(74) *Attorney, Agent, or Firm* — Blank Rome LLP

(57) ABSTRACT

This device (1) comprises two lengths of substantially inextensible material (2) and (3) that can act on the chest of the wearer. These will improve the endurance, exercise tolerance and lung function of the user. The two lengths of substantially inextensible material may be contained in a garment comprising one sleeve on the inside of the garment and the other on the outside of the garment.

4 Claims, 4 Drawing Sheets

(51) Int. Cl.

| | |
|---|---|
| ***A63B 23/12*** | (2006.01) |
| ***A63B 23/035*** | (2006.01) |
| ***A63B 23/02*** | (2006.01) |
| ***A63B 21/055*** | (2006.01) |
| ***A63B 21/002*** | (2006.01) |
| ***A63B 21/00*** | (2006.01) |
| ***A41D 13/00*** | (2006.01) |

(56) References Cited

U.S. PATENT DOCUMENTS

| | | | | |
|---|---|---|---|---|
| 3,411,500 | A | 11/1968 | Gatts | |
| 3,529,601 | A | 9/1970 | Kirkland | |
| 4,216,547 | A * | 8/1980 | Picchione | A41D 13/0015 2/22 |
| 4,506,883 | A | 3/1985 | Rathbun | |
| 4,862,523 | A | 9/1989 | Lipov | |
| 4,910,802 | A | 3/1990 | Malloy | |
| 5,659,895 | A | 8/1997 | Ford, Jr. | |
| 5,829,058 | A | 11/1998 | Dicker et al. | |
| 5,857,947 | A * | 1/1999 | Dicker | A63B 21/4025 2/69.5 |
| 2011/0230311 | A1 | 9/2011 | Gerson | |
| 2011/0314590 | A1 * | 12/2011 | Perron | A41D 13/0017 2/227 |

FOREIGN PATENT DOCUMENTS

| | | | |
|---|---|---|---|
| EP | 0 250 833 | A1 | 1/1988 |
| FR | 713107 | | 10/1931 |
| GB | 1 596 298 | | 8/1981 |
| GB | 2461072 | A | 12/2009 |
| JP | 2002-302810 | A | 10/2002 |

OTHER PUBLICATIONS http://www.wikihow.com/Bind-Your-Chest, See section "ACE bandage method".

* cited by examiner

ENHANCER

This invention relates to a fitness enhancer for the improvement of respiratory mechanics.

In a first aspect of the invention, there is provided a device comprising at least two lengths of substantially inextensible material to be worn around, to at least partially cover, a) the thorax, b) the forearm, c) the upper arm, d) the foot, ankle and calf and/or e) the thigh thereby increasing the muscular effort of the wearer and improving exercise tolerance, venous return and lymphatic drainage. As a direct piece of exercise equipment this will aid in all forms of training both land and pool based to increase overall performance and endurance when compared to not wearing the device. Examples of suitable substantially inextensible materials are stretched crepe bandages, Webasto™ and Theraband™. Preferably, the two lengths of material are also flexible.

The device does not significantly restrict the wearer's freedom of movement in flexion, extension, rotation or side bending.

The two lengths of substantially inextensible material may be provided or arranged as a pair of counter-rotating spirals. This requires the respiratory muscles to increase their function in both inspiration and expiration.

The substantially inextensible material when applied around the thorax as a spiral in one direction, be it clockwise or anticlockwise, may begin either at the lowest part of the thorax or at the highest practical level i.e. running around the armpit with the second layer running again as a spiral in the opposite direction and ending where the first layer began. Thus each spiral of material may begin at the same axial position on the wearer's thorax as the other spiral of material ends. This encourages the secondary muscles of respiration to function more than normal.

Each length of material may overlap itself. This will give a smoother transfer of effort over the area of body covered.

Preferably, the material to be worn around the thorax is at least 15 cm wide, or is at least 7 cm wide for the material to be worn around the other parts of the body, so that it will not cut into the body. This also limits the length of material required for the device to be effective.

The effect of the invention will give greater resistance to the movement of the rib cage and in doing so will increase the muscular effort of all the thoracic muscles active in respiration and increase the effort on the diaphragm. The effect of this when the invention is removed will be a greater ability to undertake exercise hence improved exercise tolerance.

There is also a direct benefit derived from its use to help all people improve venous return by enhancing the pumping effect from the diaphragm and by improving lung function which will aid in cases of things like chronic obstructive airways disease.

This is especially true when the wearer has undertaken exercise whilst wearing the invention and to a lesser extent will still have an effect even if the device has been worn whilst the wearer is at rest during the day.

With the invention being worn in the way directed an additional effect will be gained because the muscles of secondary respiration will be made to work harder as a result of the sternum being resisted in motion by the substantially inextensible material and the relative constriction effected on the thoracic region. The effect of this is to improve lung function resulting in greater vital capacity from the use of the device.

Increasing resting physical load/effort leading to increasing tone of all thoracic muscles without placing or producing increased resistance to vascular flow and will give better VO2 max and decreased cardiac effort at rest and will also achieve these under exertion so giving improved performance for sports people.

As a side effect of this the user would burn up more calories and would therefore experience weight loss if the user does not increase his/her calorie intake.

By using the invention and the method in which it is applied, there will be a resultant change in the mechanics of the thoracic region, the area bound at the bottom by the diaphragm and at the top by the tissues forming the neck and throat which result in effectively a closed box being comprised of the spine at the rear and the sternum at the front and the area forming the rest of the box being the ribs themselves. The diaphragm which divides the abdomen from the thorax on inspiration attempts to move inferiorly which requires the lower ribs to act in a so called bucket handle fashion to allow this motion to occur and superiorly at the top of the box the boundary is formed by the shoulder girdle and muscles that cover over the coverings of the lungs both right and left and the muscles from the head and neck and attaching to the first rib and sternum. The constricting effect that is the result of the application of the invention resists the motions of the upper ribs which in this region function as a pump handle type effect and thus will work the secondary muscles that attach to the sternum and rib cage. When the invention is removed there will be a resultant effect of relaxation in these muscles even if the wearer now undertakes exercise. This will also have an added benefit of improving the thoracic mechanics giving a greater pump effort by the diaphragm which will improve venous return to the heart and lower the strain on the heart.

The invention when applied as described above will increase the tidal volume into and out of the lungs. The raised volume of airflow will have the effect of increasing the available amount of oxygen for gaseous exchange at the surface of the lungs in the alveoli and it will also mean that more carbon dioxide can be removed with each breath. With an increased oxygen availability it will also give greater oxygen available to carry to all cells of the body which for muscles will lead to more oxygen and less need for anaerobic exercise so lessening "cramp" effects on exertion, and tissue repair will also be enhanced.

The combined benefits derived above will mean that both the raised intensity of activity will be possible and, by providing the extra gaseous exchange, this will mean that aerobic stamina will also be enhanced. The invention could thus be said to act as an exercise machine for the lungs and unlike all exercise equipment normally this is only possible to work whilst the individual is physically working. Here though the lungs will also be exercised whilst at rest. This will produce therefore benefits in all areas as stated above whilst the lungs are in theory not being worked above their minimum level of effort.

The invention from all that has been described above will have the beneficial effect of increasing the energy needs of the wearer even if not exercising but for example sitting down and reading. In doing this there would be set a new base metabolic rate for the wearer. This will have the effect of "burning" more calories to just sit, and even more calories taking gentle exercise like walking on the flat.

The heart is the muscular pump that pushes the blood around the vascular system of the body. This explains that the heart working is the only means without outside help to keep the body alive. For this reason anything that can help is very useful. This invention works by improving the diaphragmatic pump effect which has two main advantages.

The first being to decrease the peripheral resistance in the vascular system so lessening the pressure the heart will be pumping at and this is further enhanced by the priming effect of the pump by the increased venous return to the right side of the heart. The second also by working on the thoracic mechanics the ejection pressure of the right side will also be helped as the lungs will function better as well as being under less strain.

The above effects having been laid out that the device will help or perform will also have the benefit that having developed the changes in the thoracic muscles it will also result in the wearer having a heightened and sustained ability to be able to carry out exertion after its prolonged usage as part of an exercise programme or just as a result of the effects of wearing it at rest.

In a second aspect of the invention, there is provided a garment comprising the two lengths of substantially extensible material. The garment may be composed so that the two lengths of substantially extensible material are contained within one sleeve on the inside of the garment and another sleeve on the outside of the garment which together form counter-rotating spirals. To allow the wearer to easily fit and remove the garment, the wearer may be able to tighten and loosen both lengths of material.

In a third aspect of the invention, there is provided a method comprising wrapping at least two lengths of substantially inextensible material tightly around, to at least partially cover, a) the thorax, b) the forearm, c) the upper arm, d) the foot, ankle and calf and/or e) the thigh thereby increasing the muscular effort of the wearer and improving exercise tolerance, venous return and lymphatic drainage.

Figure 1:
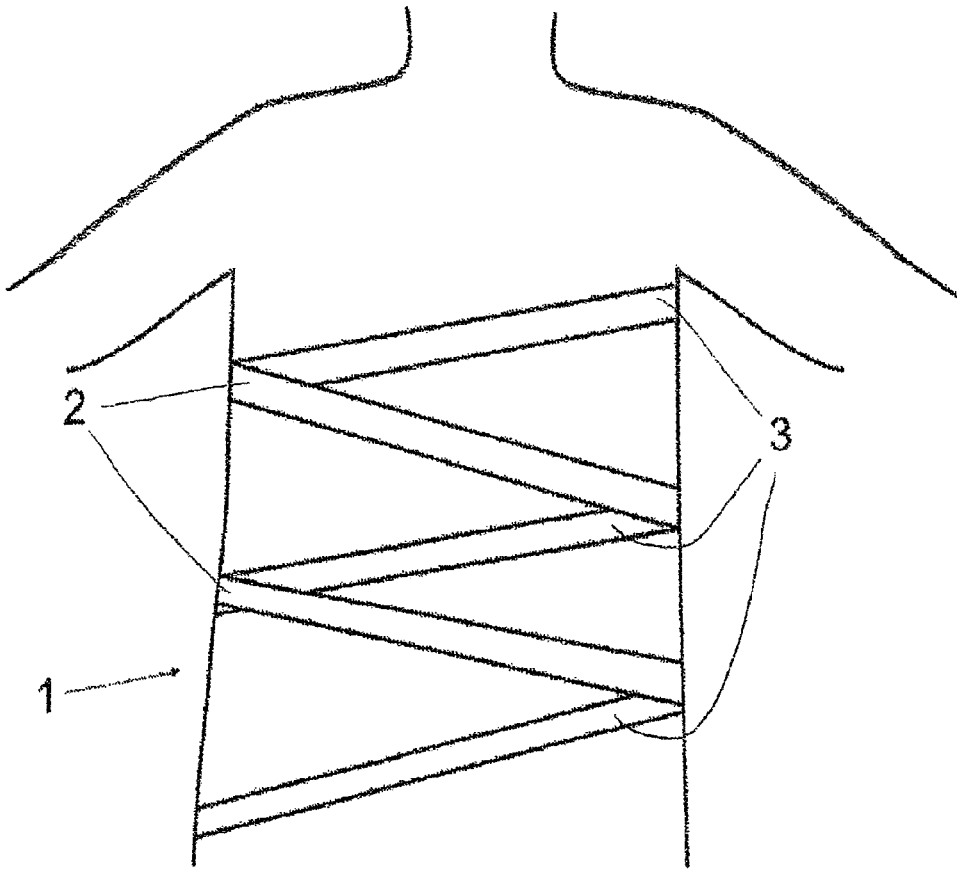
FIG. 1 shows a device according to an embodiment of the invention being worn.

Referring to FIG. 1, a device 1 comprising two lengths of substantially inextensible material 2, 3 is worn tightly around, to at least partially cover, the thorax thereby increasing the muscular effort of the wearer and improving exercise tolerance. FIG. 1 shows only the sections of the lengths of material 2, 3 that are on the front of the thorax. Although not shown in FIG. 1, the spiral formed by the length of material 2 begins (when considered to pass from top to bottom of the thorax) at the same axial position on the thorax as the spiral of material formed by length of material 3 ends (the uppermost section of material 2 is not shown in FIG. 1 because it is on the back of the thorax).

An example of a preferred material could be a crepe bandage which is preferably arranged as counter rotating spirals, one beginning at the same axial position as the endpoint of the second spiral. The crepe bandage for example would be pulled tight so that it is no longer extensible and then applied around the thorax as described previously after the wearer has inhaled and then exhaled the first crepe would be thus applied. After inhaling and exhaling fully again the second crepe bandage would be applied in the same way as the first beginning at the endpoint of the first and ending at the beginning point axially of the first to the same degree of tightness thereby restricting the thorax and enhancing the effort of the wearer.

Figure 2:
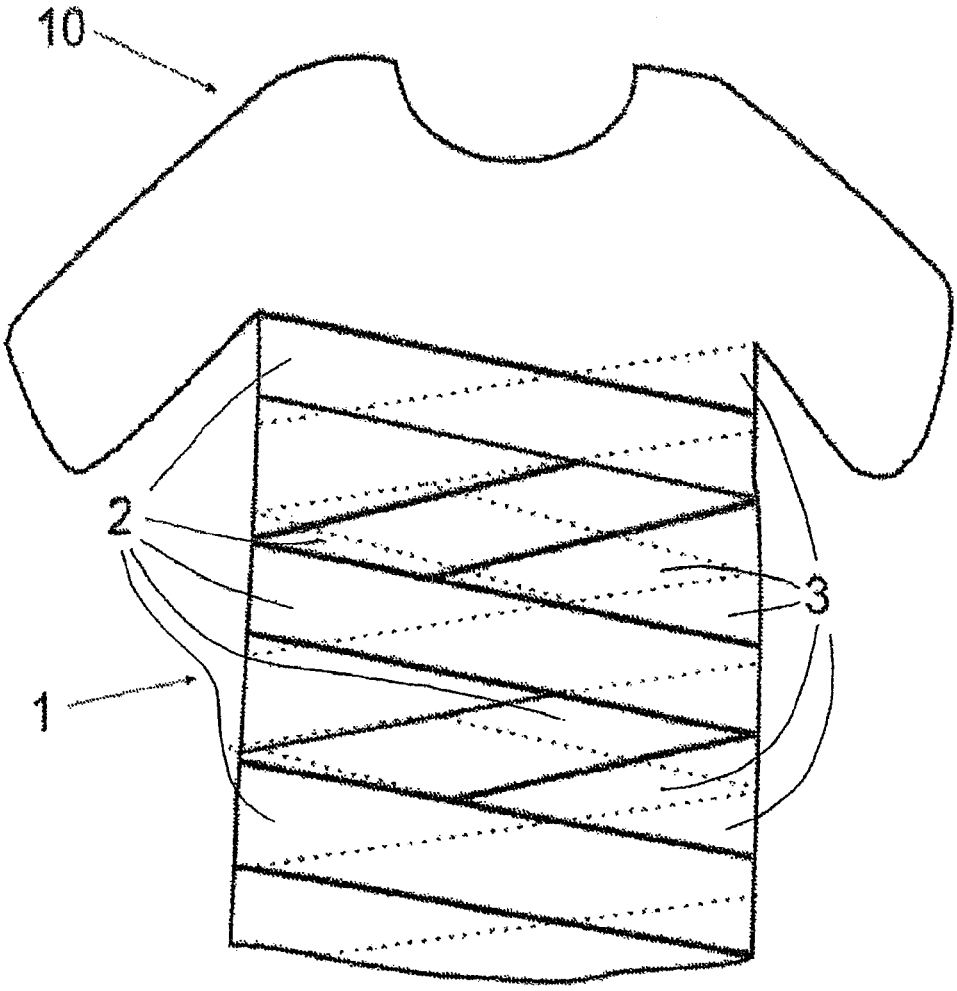
FIG. 2 shows a garment according to an embodiment of the invention.

Referring to FIG. 2, a garment 10 comprises the device 1 of two lengths of substantially inextensible material 2, 3 shown in FIG. 1. In contrast to FIG. 1, FIG. 2 shows the sections of the lengths of material that are on both the front and back of the garment 10. The arrangement of the lengths of material 2, 3 in the garment 10 of FIG. 2 is different from that of the lengths of material 2, 3 of the device 1 of FIG. 1 in that the spiral formed by length of material 2 does not begin at the same point around the garment 10 as the spiral formed by length of material 3. However, the spiral formed by length of material 2 begins at the same axial point on the garment 10 as the spiral formed by length of material 3 ends. Each length of material 2, 3 is provided within a respective sleeve but for simplicity the sleeves are not shown in FIG. 2.

Figure 3:
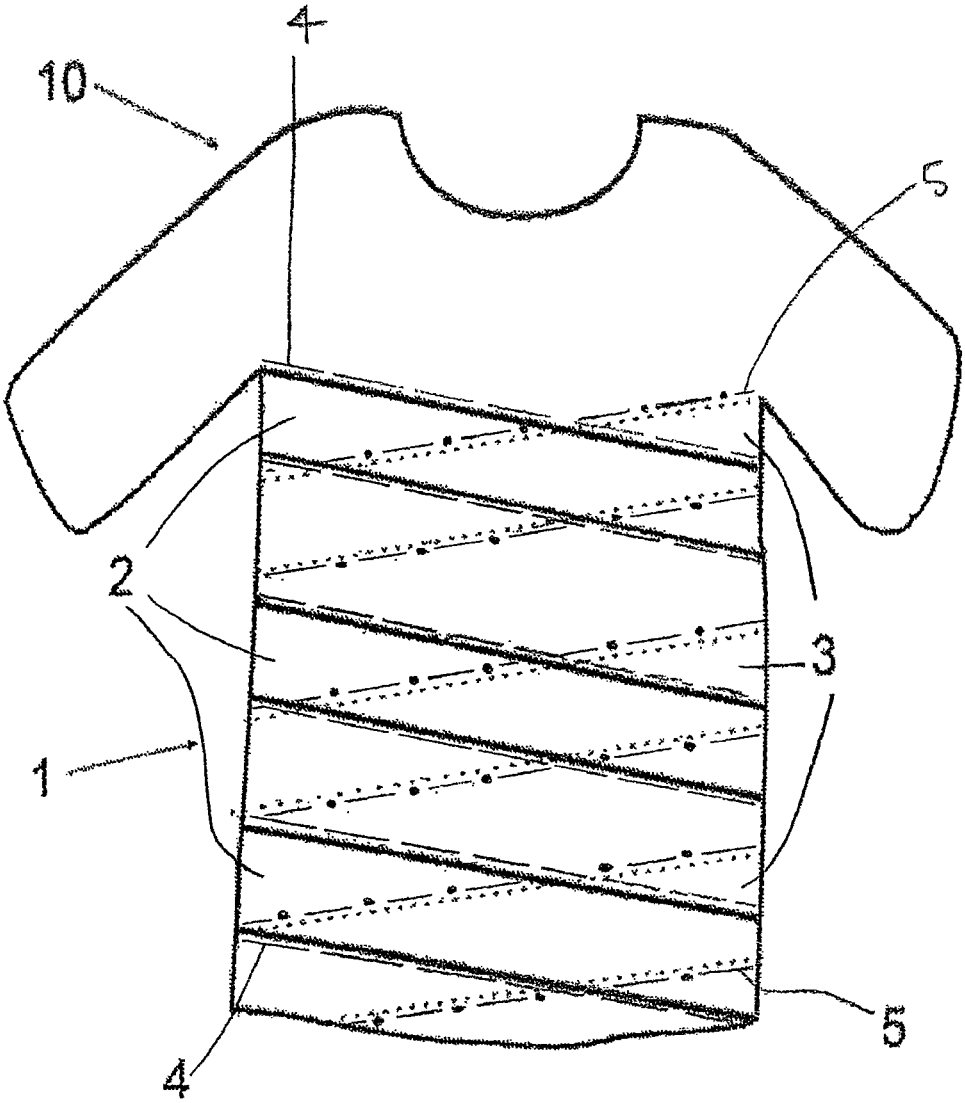
FIG. 3 shows a garment according to an embodiment of the invention.

Referring to FIG. 3, a garment 10 comprises the device 1 of two lengths of substantially inextensible material 2, 3 shown in FIG. 1. In contrast to FIG. 2, FIG. 3 shows only the sections of the lengths of material 2, 3 that are on the front of the garment 10, for simplicity. Each length of material 2, 3 is provided within a respective sleeve 4, 5 on either side of the garment 10. The sleeves are attached to the garment. Each length of material 2, 3 can slide within its respective sleeve 4, 5 allowing the tightness of the lengths of material 2, 3 around the thorax to be adjusted. Only the sections of the sleeves 4, 5 that are on the front of the garment 10 are shown, for simplicity.

The tightness applied by the two lengths of material 2, 3 to the thorax would be as described above.

Figure 4:
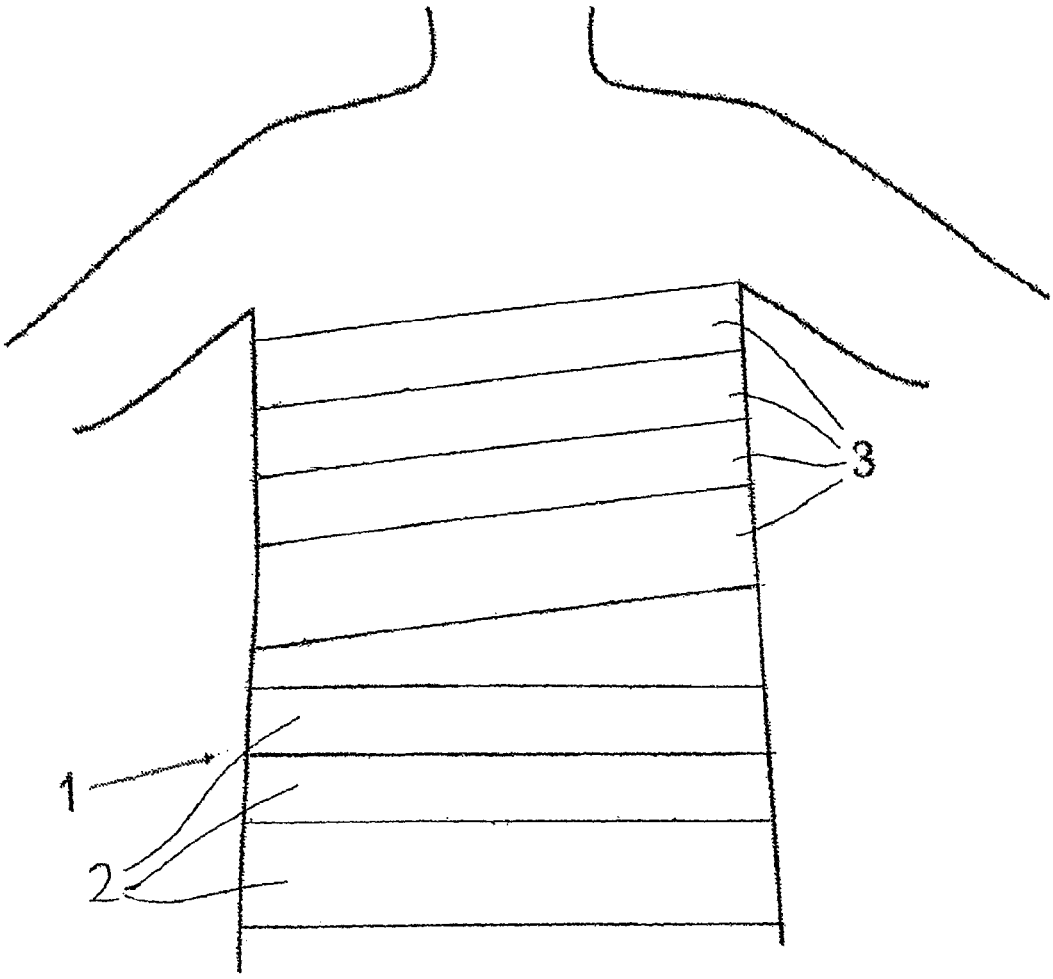
FIG. 4 shows a device according to an embodiment of the invention being worn.

Referring to FIG. 4, a device 1 comprising two lengths of substantially inextensible material 2, 3 is worn tightly around, to at least partially cover, the thorax thereby increasing the muscular effort of the wearer and improving exercise tolerance. FIG. 4 shows only the sections of the lengths of material 2, 3 that are on the front of the thorax. For simplicity, in FIG. 4 only the length of material 3 is shown at the top of the thorax, and only the length of material 2 is shown at the bottom of the thorax. However, both lengths of material 2, 3 would be worn at the to and bottom of the thorax. FIG. 4 shows length of material 2 overlapping itself at the bottom of the thorax, and length of material 3 overlapping itself at the top of the thorax.

The invention claimed is:

1. A garment comprising a device comprising two lengths of substantially inextensible material to be worn tightly around, to at least partially cover, the thorax, thereby increasing the muscular effort of the wearer and improving exercise tolerance, venous return and lymphatic drainage, wherein the two lengths of substantially inextensible material are provided as a pair of counter-rotating helices, wherein one of the lengths of substantially inextensible material is arranged within a sleeve on the inside of the garment, and the other of the lengths of substantially inextensible material is arranged within a sleeve on the outside of the garment.

2. A garment according to claim 1, wherein each helix of material begins at the same axial position on the wearer's thorax as the other helix of material ends.

3. A garment according to claim 1, wherein each length of material overlaps itself.

4. A garment according to claim 1, wherein each length of substantially inextensible material is at least 15 cm in width.

* * * * *